US007300143B2

(12) United States Patent
Slotto et al.

(10) Patent No.: US 7,300,143 B2
(45) Date of Patent: Nov. 27, 2007

(54) INK JET APPARATUS

(75) Inventors: Steven R. Slotto, Camas, WA (US); Brian E. Sonnichsen, Portland, OR (US); Eric Segerstrom, Austin, TX (US); David R. Koehler, Sherwood, OR (US)

(73) Assignee: Xerox Corporation, Stamford, CT (US)

( * ) Notice: Subject to any disclaimer, the term of this patent is extended or adjusted under 35 U.S.C. 154(b) by 366 days.

(21) Appl. No.: 11/099,927

(22) Filed: Apr. 5, 2005

(65) Prior Publication Data

US 2006/0221146 A1 Oct. 5, 2006

(51) Int. Cl.
*B41J 2/175* (2006.01)

(52) U.S. Cl. ..... 347/86

(58) Field of Classification Search ..... 347/85, 347/86, 88; 141/2, 18
See application file for complete search history.

(56) References Cited

U.S. PATENT DOCUMENTS 4,999,652 A * 3/1991 Chan ..... 347/86
5,123,961 A * 6/1992 Yamamoto ..... 106/31.29
5,966,156 A * 10/1999 Scheffelin et al. ..... 347/86
6,293,649 B1 * 9/2001 Norton ..... 347/37
6,302,530 B1 * 10/2001 Shimada et al. ..... 347/86
6,550,899 B1 * 4/2003 Cowger et al. ..... 347/86
6,957,882 B2 * 10/2005 Wouters et al. ..... 347/86
7,121,656 B2 * 10/2006 Hattori ..... 347/86

OTHER PUBLICATIONS

U.S. Appl. No. 10/786,371, entitled "Ink Jet Apparatus" filed Feb. 25, 2004, by Brian E. Sonnischsen, et al.

* cited by examiner

*Primary Examiner*—Anh T. N. Vo
(74) *Attorney, Agent, or Firm*—Fay Sharpe LLP

(57) ABSTRACT

A fluid reservoir apparatus including a housing having input ports in a rear portion of the housing and output ports in a front portion of the housing, fluidic chambers and fluidic channels extending from the input ports to the output ports, a heater structure disposed in the housing, a plurality of datum standoffs having rounded datum ends disposed at the rear portion of the housing.

7 Claims, 10 Drawing Sheets

INK JET APPARATUS

BACKGROUND

The subject disclosure is generally directed to drop jetting apparatus such as ink jet printing.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper. Some ink jet printheads employ melted solid ink.

DETAILED DESCRIPTION

Figure 1:
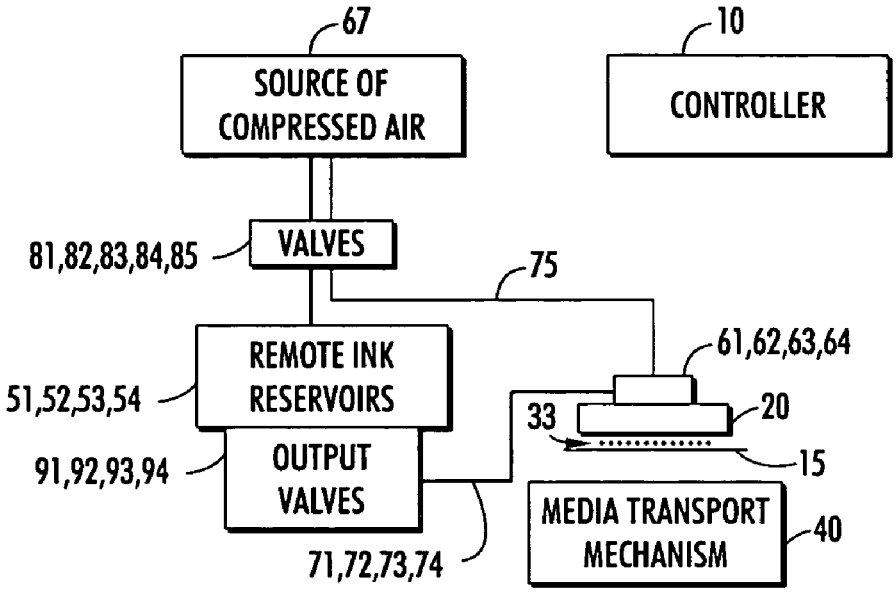
FIG. 1 is a schematic block diagram of an embodiment of an ink jet printing apparatus that includes remote ink reservoirs.
Figure 3:
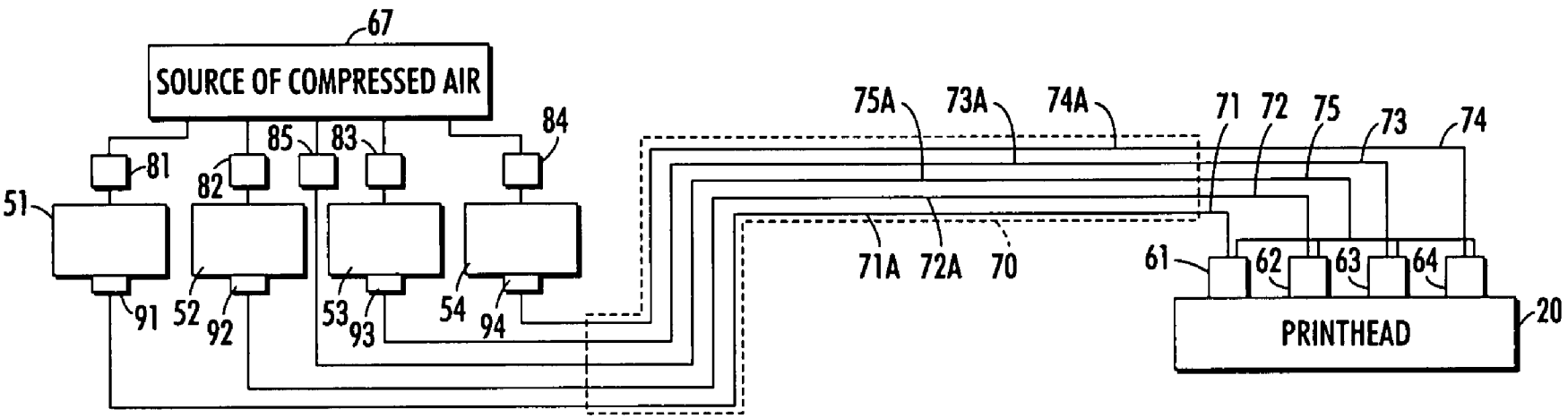
FIG. 3 is a schematic block diagram of an embodiment of ink delivery components of the ink jet printing apparatus of FIGS. 1 and 2.

FIGS. 1 and 3 are schematic block diagrams of an embodiment of an ink jet printing apparatus that includes a controller 10 and a printhead 20 that can include a plurality of drop emitting drop generators for emitting drops of ink 33 onto a print output medium 15. A print output medium transport mechanism 40 can move the print output medium relative to the printhead 20. The printhead 20 receives ink from a plurality of on-board ink reservoirs 61, 62, 63, 64 which are attached to the printhead 20. The on-board ink reservoirs 61-64 respectively receive ink from a plurality of remote ink containers 51, 52, 53, 54 via respective ink supply channels 71, 72, 73, 74. The remote ink containers 51-54 can be selectively pressurized, for example by compressed air that is provided by a source of compressed air 67 via a plurality of valves 81, 82, 83, 84. The flow of ink from the remote containers 51-54 to the on-board reservoirs 61-64 can be under pressure or by gravity, for example. Output valves 91, 92, 93, 94 can be provided to control the flow of ink to the on-board ink reservoirs 61-64.

The on-board ink reservoirs 61-64 can also be selectively pressurized, for example by selectively pressurizing the remote ink containers 51-54 and pressurizing an air channel 75 via a valve 85. Alternatively, the ink supply channels 71-74 can be closed, for example by closing the output valves 91-94, and the air channel 75 can be pressurized. The on-board ink reservoirs 61-64 can be pressurized to perform a cleaning or purging operation on the printhead 20, for example. The on-board ink reservoirs 61-64 and the remote ink containers 51-54 can be configured to contain melted solid ink and can be heated. The ink supply channels 71-74 and the air channel 75 can also be heated.

The on-board ink reservoirs 61-64 are vented to atmosphere during normal printing operation, for example by controlling the valve 85 to vent the air channel 75 to atmosphere. The on-board ink reservoirs 61-64 can also be vented to atmosphere during non-pressurizing transfer of ink from the remote ink containers 51-54 (i.e., when ink is transferred without pressurizing the on-board ink reservoirs 61-64).

Figure 2:
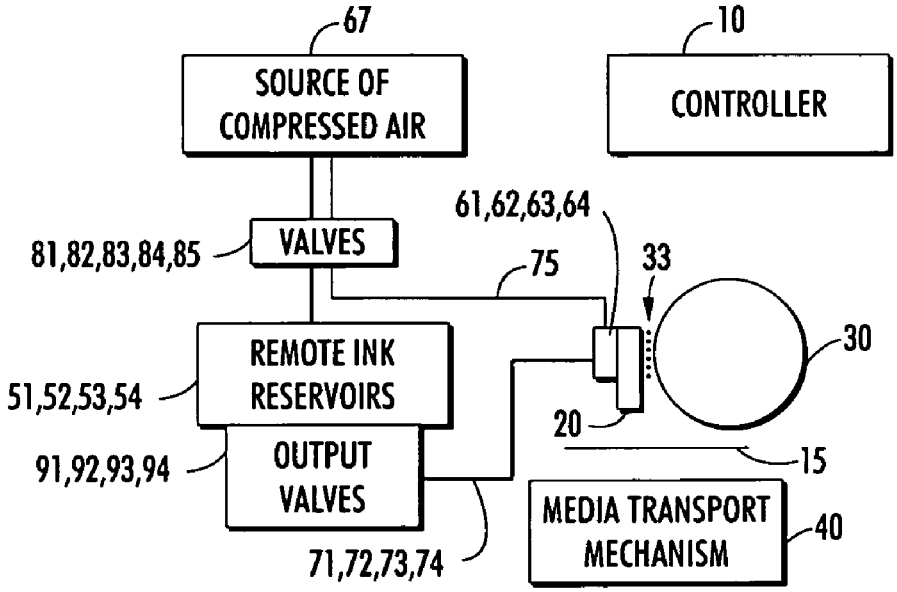
FIG. 2 is a schematic block diagram of another embodiment of an ink jet printing apparatus that includes remote ink reservoirs.

FIG. 2 is a schematic block diagram of an embodiment of an ink jet printing apparatus that is similar to the embodiment of FIG. 1, and includes a transfer drum 30 for receiving the drops emitted by the printhead 20. A print output media transport mechanism 40 rollingly engages an output print medium 15 against the transfer drum 30 to cause the image printed on the transfer drum to be transferred to the print output medium 15.

As schematically depicted in FIG. 3, a portion of the ink supply channels 71-74 and the air channel 75 can be implemented as conduits 71A, 72A, 73A, 74A, 75A in a multi-conduit cable 70.

FIGS. 4-5, 6-7, and 8-9 schematically illustrate embodiments of a reservoir assembly 60 that can implement the on-board reservoirs 61, 62, 63, 64. The reservoir assembly generally includes a rear panel 111 and a front panel 121. Located between the rear panel 111 and the front panel 121 are a first thermally conductive heater plate 113, an elastomeric heater sheet or panel 115, a second thermally conductive heater plate 117, and a filter assembly 119. The rear panel 111 can generally comprise a rear portion of the reservoir assembly, while the front panel 121 can generally comprise a front portion of the reservoir assembly.

The rear panel 111 includes chambers that together with the first thermally conductive heater plate 113 form reservoirs 61, 62, 63, 64 that respectively receive ink via respective input ports 171, 172, 173, 174 that are respectively connected to the supply channels 71, 72, 73, 74.

Figure 5:
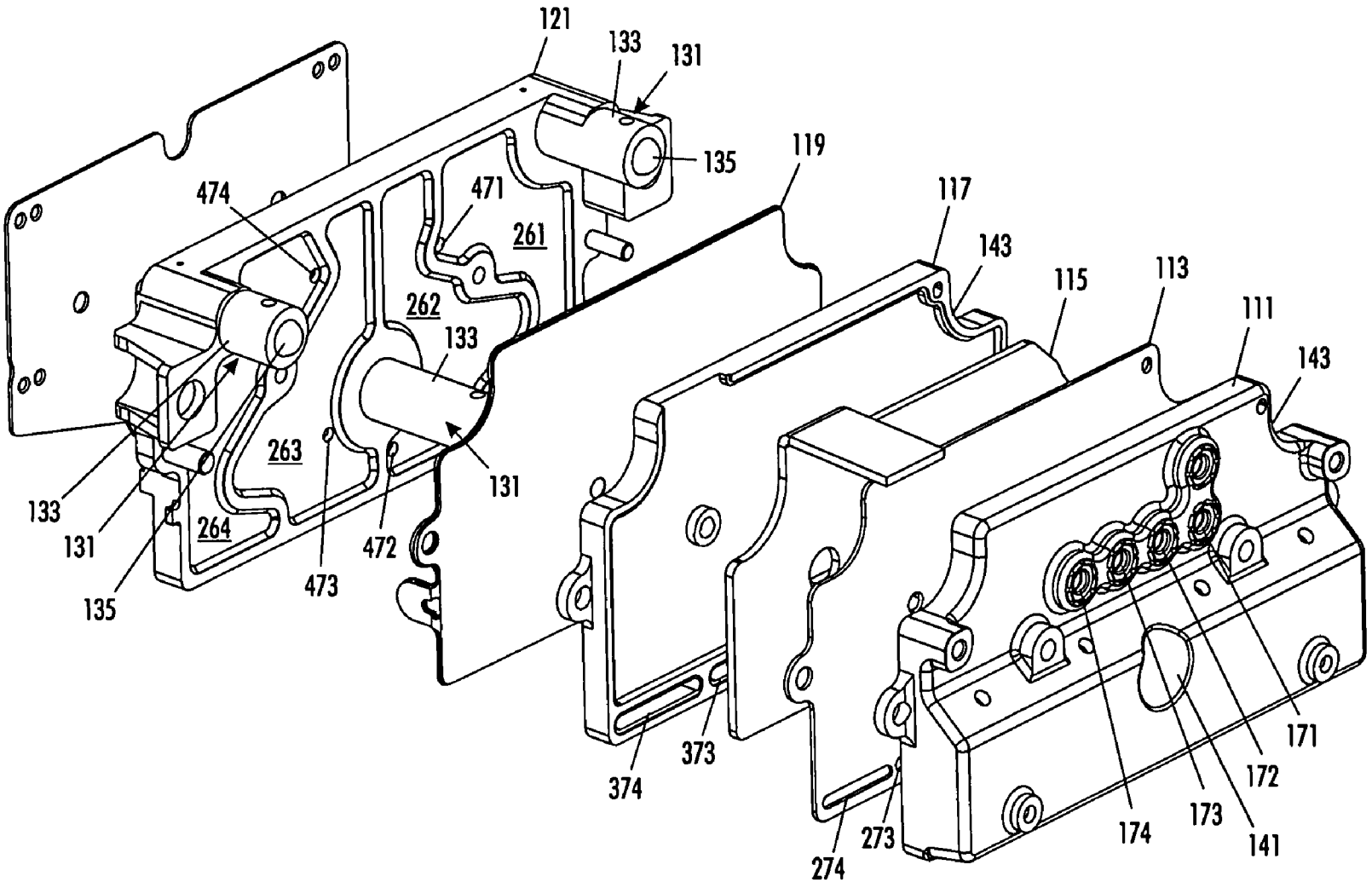
Figure 6:
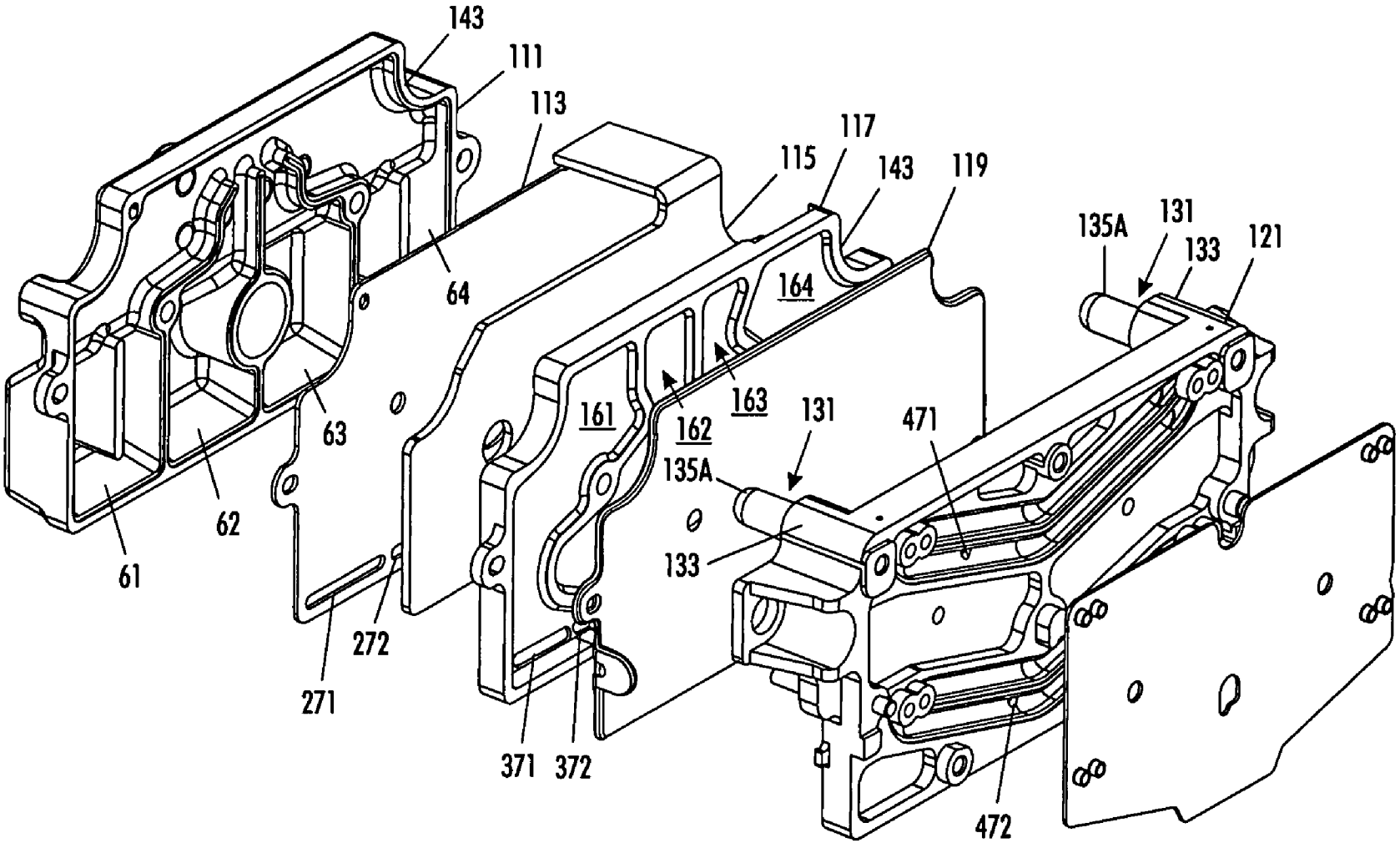
FIG. 6 and FIG. 7 are schematic front and back assembly illustrations of another embodiment of an ink reservoir.

The second heater plate 117 can include a recess 117A (FIG. 5) for locating the elastomeric heater panel 115 which is compressed between opposing walls of the first and second thermally conductive heater plates 113, 117, and has a uncompressed thickness that is greater than the distance in the recess 117A between the opposing walls of the heater plates 113, 117, as schematically depicted in FIG. 6. In this manner, the contact between the elastomeric heater panel 115 and the first and second heater plates 113, 117 can be optimal. By way of illustrative example, the elastomeric heater sheet or panel 115 can comprise a silicone heater. By way of illustrative example, the elastomeric heater can be compressed into a cavity formed by the recess 117A and the adjacent wall of the first heater plate 113.

The second heater plate 117 can further include filter input pockets, recesses or cavities 161, 162, 163, 164 (FIG. 4) that are fluidically connected to respective reservoirs 61, 62, 63, 64 by slots or channels 271, 272, 273, 274 formed in the first heater plate 113 and slots or channels 371, 372, 373, 374 formed in the second heater plate 117, for example along corresponding edges thereof.

The front panel 121 includes output filter pockets, recesses or cavities 261, 262, 263, 264 (FIG. 5) that are respectively opposite the cavities 161, 162, 163, 164 in the second heater plate 117 and fluidically coupled thereto by the filter assembly 119.

While a flat heater structure is disclosed by way of illustrative example, it should be appreciated that other heater structures can be employed.

Figure 4:
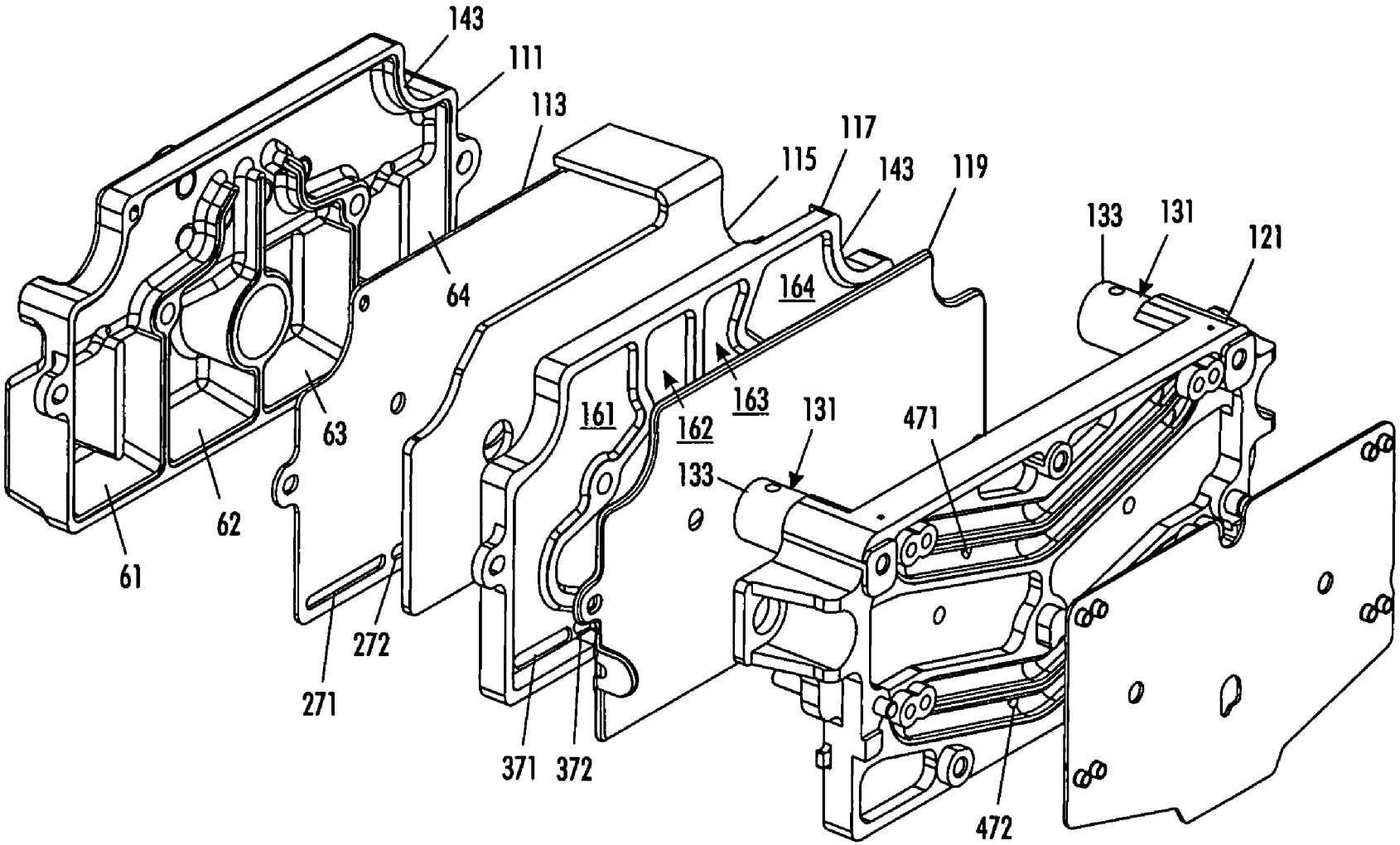
FIG. 4 and FIG. 5 are schematic front and back assembly illustrations of an embodiment of an ink reservoir.
Figure 7:
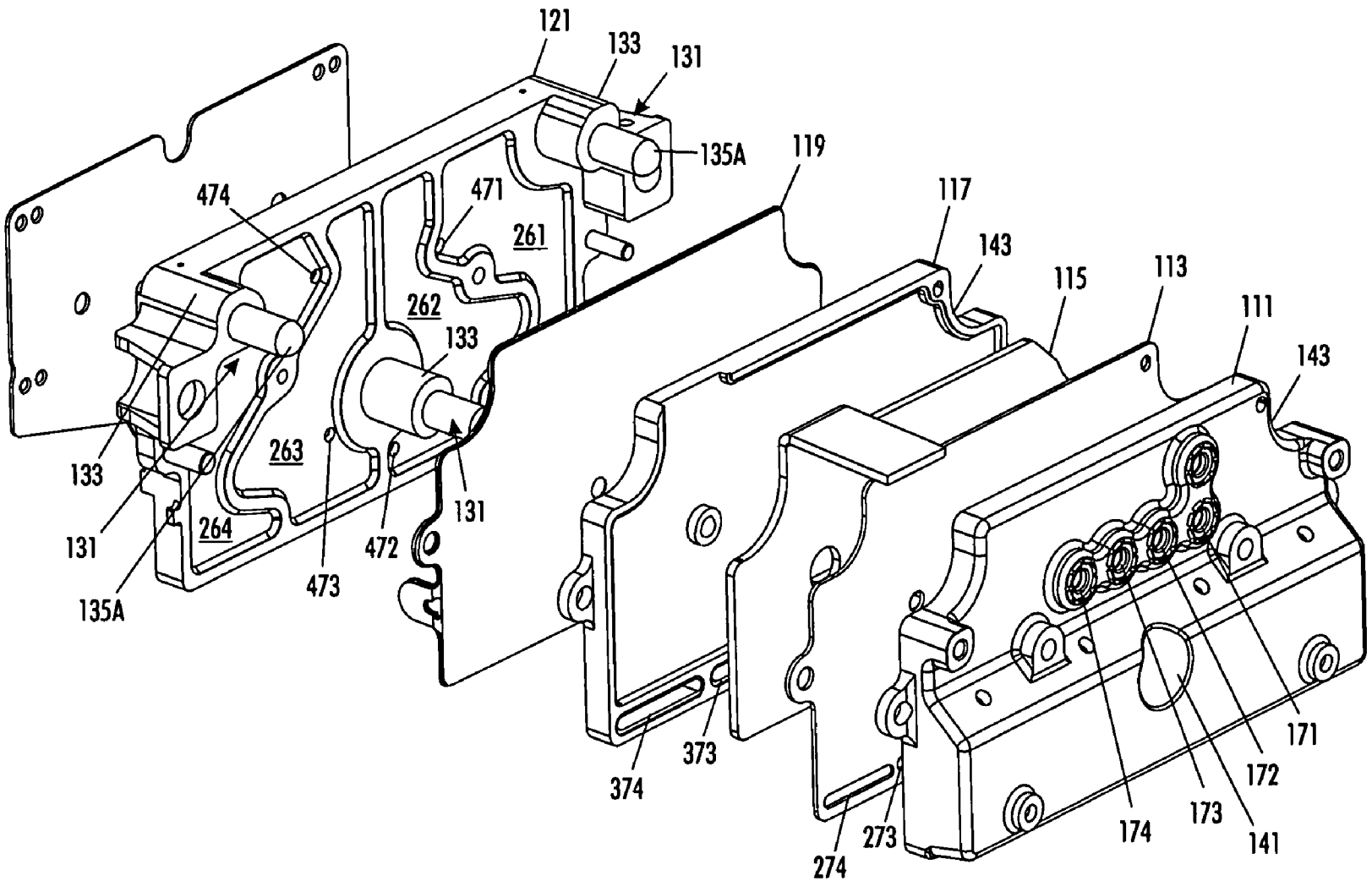
Figure 8:
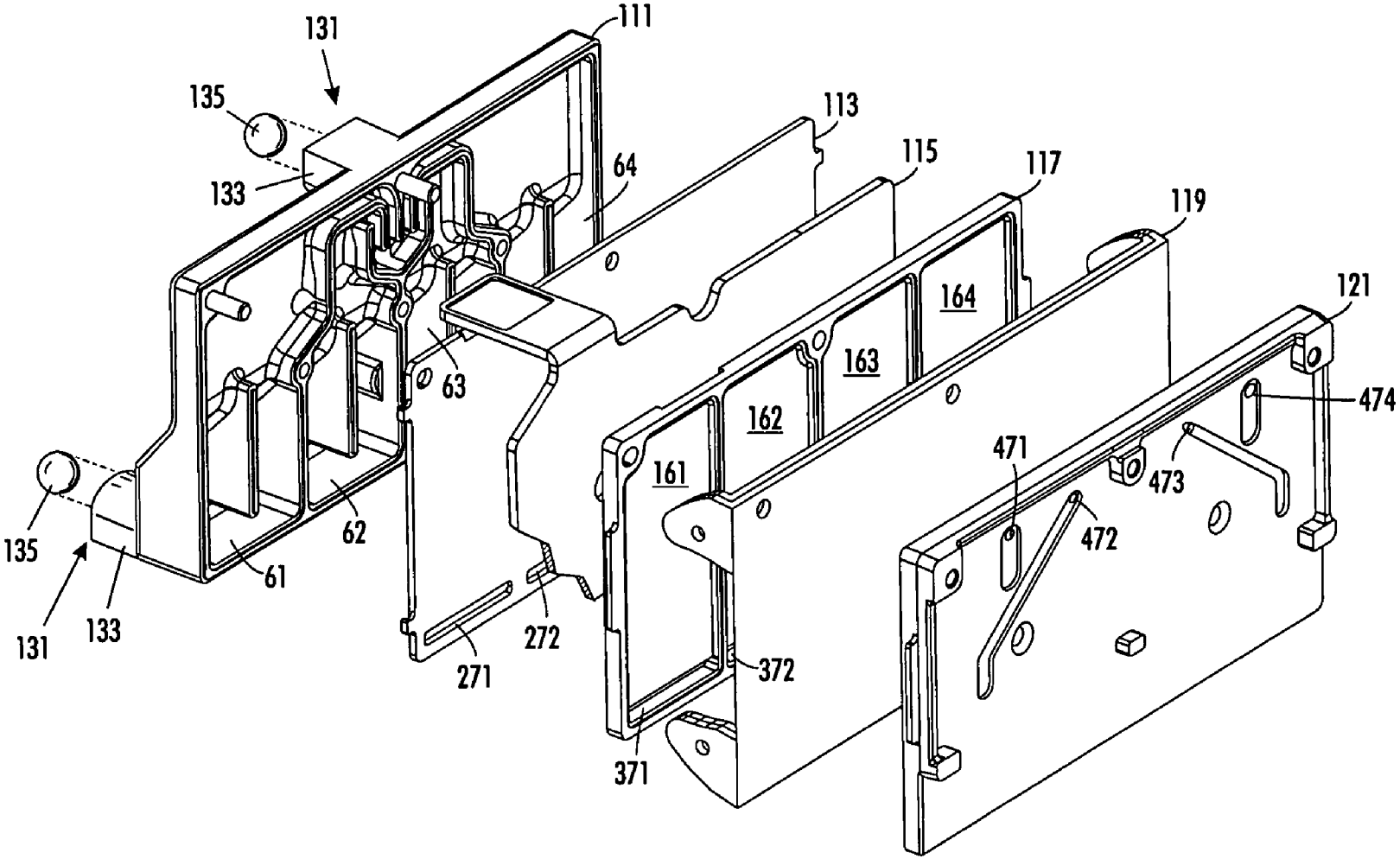
FIG. 8 and FIG. 9 are schematic front and back assembly illustrations of a further embodiment of an ink reservoir.
Figure 9:
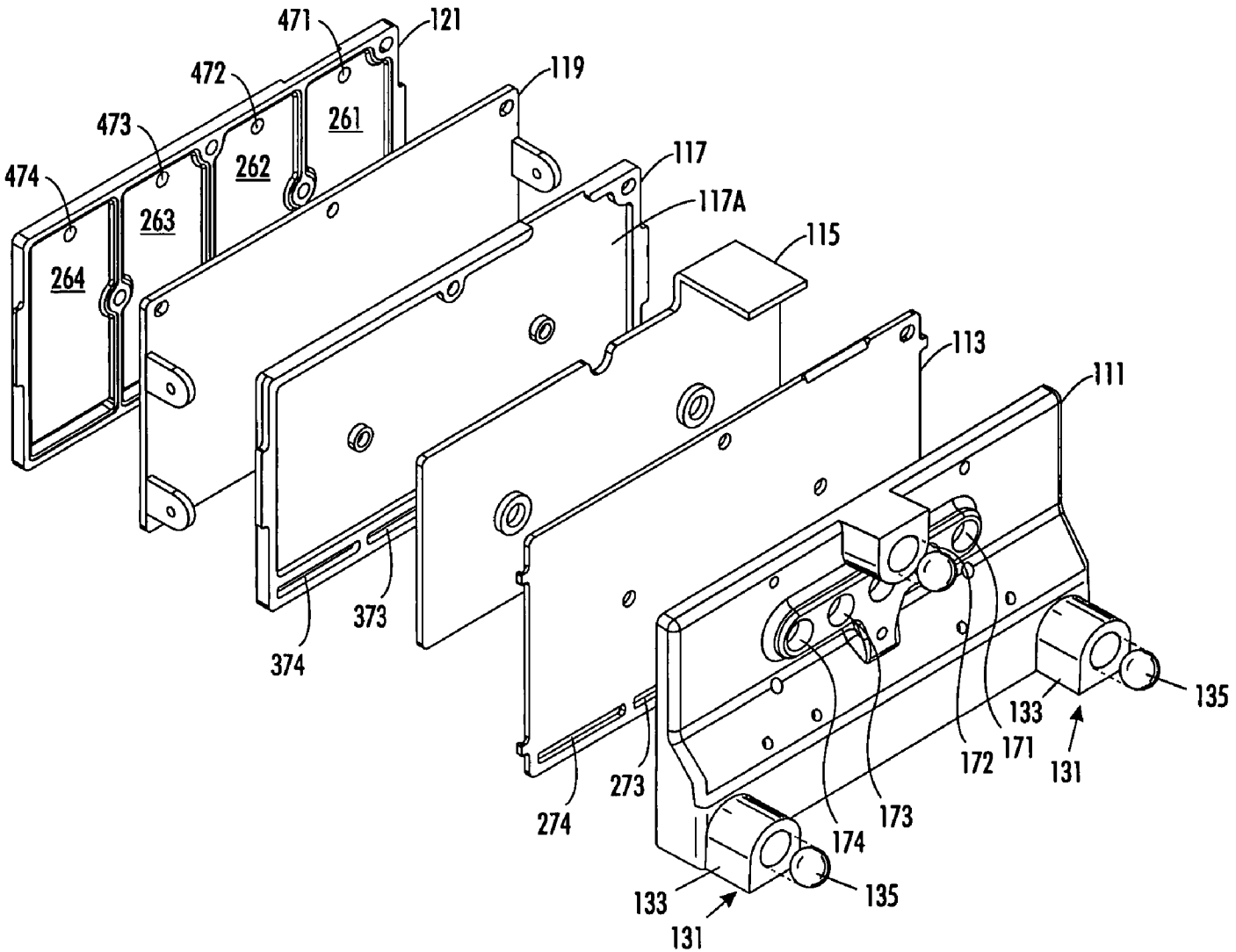

The reservoir assembly further includes datum standoffs 131 having rounded datum ends disposed at the rear portion of the reservoir structure. More generally, the datum standoffs extend rearwardly at the rear portion of the fluid reservoir structure. In this manner, the input ports 171, 172, 173, 174 and the datum ends of the datum standoffs 131 can be generally at the rear portion of the fluid reservoir structure. The rounded datum ends can be generally hemispherical, for example. By way of illustrative example, as shown in FIGS. 4-5, the datum standoffs 131 can comprise rearwardly extending datum posts 133 and datum balls 135 fixedly disposed in the ends of the datum posts 133. Alternatively, as shown in FIGS. 6 and 7, the datum standoffs 131 can comprise datum posts 133 and hemispherically ended pins or pegs 135A fixedly disposed in the ends of the datum posts 133. By way of illustrative example, the datum posts 133 can be attached to or integral with the front panel 121 and extend through or by passages such as openings 141 or indentations 143 formed in the filter assembly 119, the second heater plate 117, the heater 115, the first heater plate 113, and the rear panel 111, as appropriate for the particular implementation. As another example, the datum posts 133 can be attached to or integral with the rear panel 111, for example as schematically illustrated in FIGS. 8-9.

The rear panel, the intermediate panels, and the front panel thus form a housing that contains fluidic chambers and fluidic channels extending from the fluidic input ports to the output ports which are generally on opposite sides of such housing. The datum standoffs are generally disposed at a rear portion of the housing, and can be attached to or integral with a front portion of the housing or the rear portion of the housing.

Figure 10:
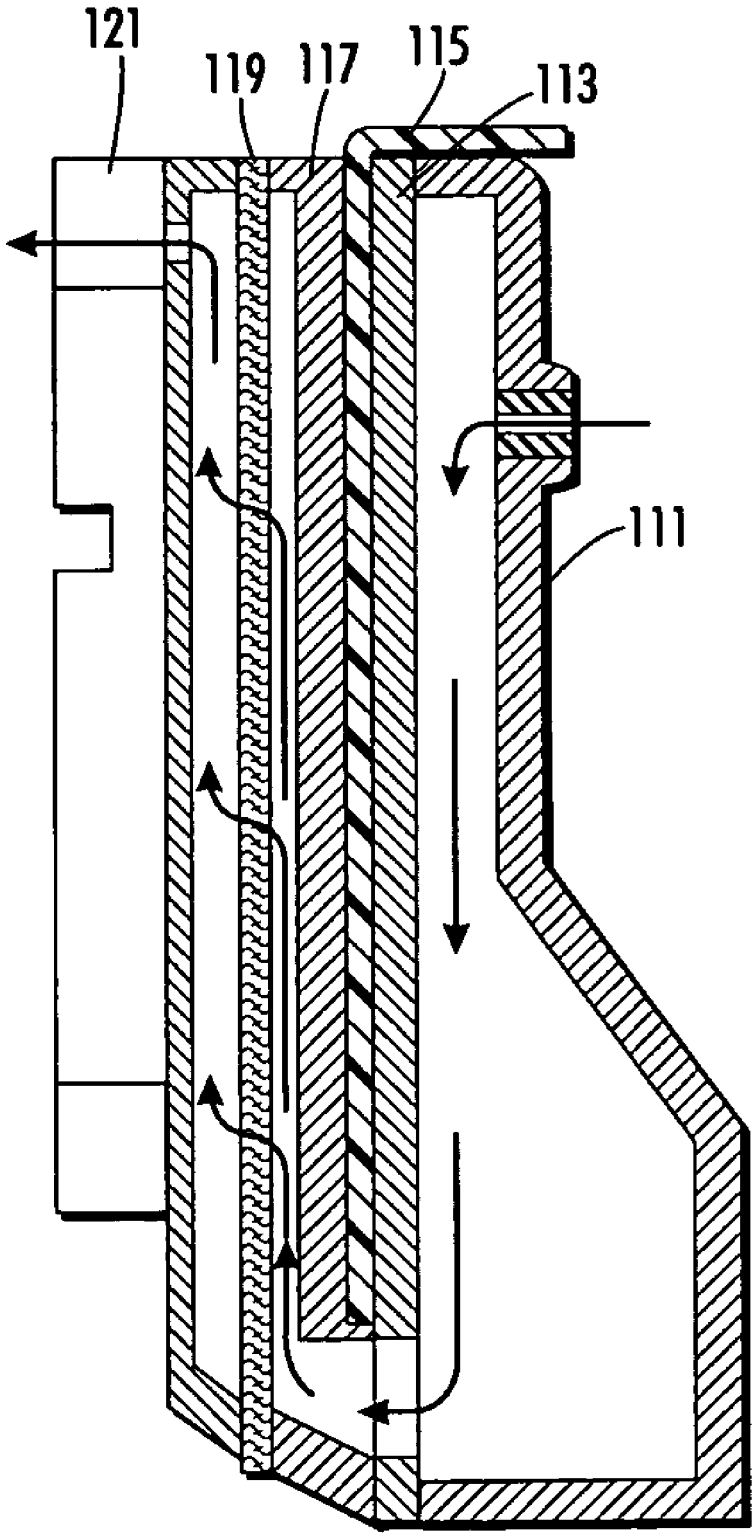
FIG. 10 is a schematic elevational sectional view of the ink reservoir of FIGS. 4 and 5, FIGS. 6 and 7, and FIGS. 8 and 9.

As generally schematically depicted in FIG. 10, ink flows from the reservoirs 61, 62, 63, 64 through the channels 271, 272, 273, 274 and the channels 371, 372, 373, 374 to the input filter cavities 161, 162, 163, 164. The ink then flows from the input filter cavities 161, 162, 163, 164 through the filter assembly 113 to the output filter cavities 261, 262, 263, 264. Filtered ink flows to the printhead 20 (FIGS. 1-3) via output ports 471, 472, 474, 474 (FIG. 4) in the front panel 121.

By way of illustrative example, the back plate 111, the first heater plate 113, the second heater plate 117, the filter assembly 119, and the front plate 121 can comprise thermally conductive material such as stainless steel or aluminum, such that all of such plates are thermally coupled to elastomeric heater sheet or panel 115. The reservoirs 61, 62, 63, 64, the filter output cavities 161, 162, 163, 164, and the filter output cavities are also thermally coupled to the elastomeric heater 115.

Figure 11:
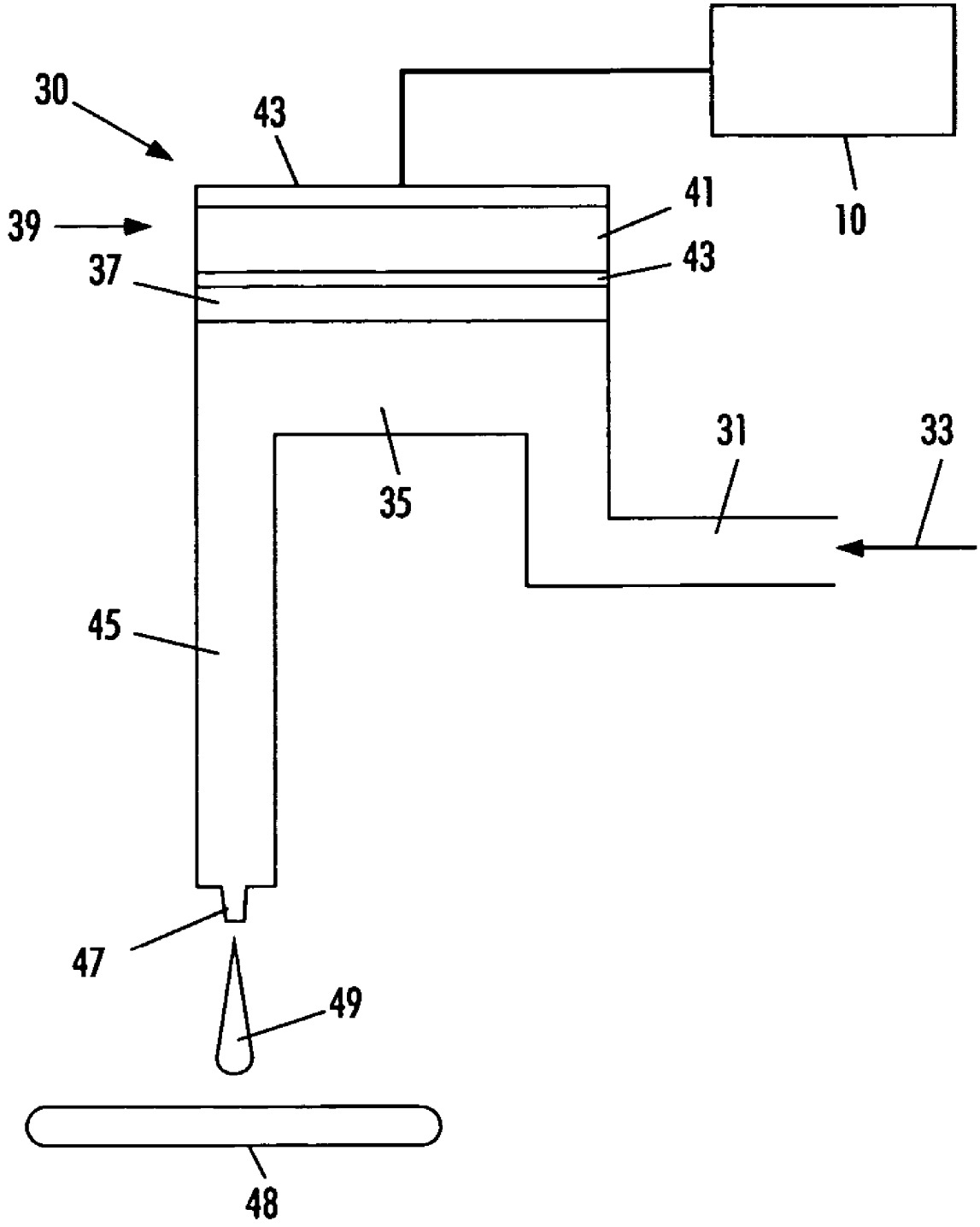
FIG. 11 is a schematic block diagram of an embodiment of a drop generator that can be employed in the printhead of the ink jet printing apparatus of FIG. 1 and in the printhead of the ink jet printing apparatus of FIG. 2.

FIG. 11 is a schematic block diagram of an embodiment of a drop generator 30 that can be employed in the printhead 20 of the printing apparatus shown in FIG. 1 and the printing apparatus shown in FIG. 2. The drop generator 30 includes an inlet channel 31 that receives melted solid ink 33 from a manifold, reservoir or other ink containing structure. The melted ink 33 flows into a pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface or a print output medium, for example. The outlet channel 45 can include a nozzle or orifice 47.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A fluid reservoir apparatus comprising:

a rear panel having plurality of fluidic input ports on a rear portion thereof and a plurality of chambers respectively fluidically coupled to the fluidic input ports;

a front panel having a plurality of fluidic output ports on a front portion thereof;

a plurality of intermediate panels disposed between the rear panel and the front panel;

wherein the rear panel, the intermediate panels, and the front panel form a housing that contains fluidic chambers and fluidic channels extending from the fluidic input ports to the output ports which are generally on opposite sides of such housing;

a heater structure disposed in the housing; and a plurality of datum standoffs disposed at the rear portion of rear panel and having rounded datum ends.

2. The fluid reservoir apparatus of claim 1 wherein the datum standoffs include rearwardly extending datum posts.

3. The fluid reservoir apparatus of claim 1 wherein the datum standoffs include datum posts that are integral with the front panel and extend rearwardly from the front panel.

4. The fluid reservoir apparatus of claim 1 wherein the datum standoffs include datum posts that are integral with the rear panel and extend rearwardly from the rear panel.

5. The fluid reservoir apparatus of claim 1 wherein the datum standoffs include datum balls.

6. The fluid reservoir apparatus of claim 1 wherein the datum standoffs include rearwardly extending datum pins having rounded ends.

7. The fluid reservoir apparatus of claim 1 wherein each of the input ports receives melted solid ink.

* * * * *